United States Patent [19]

Sakata et al.

[11] Patent Number: 5,047,892

[45] Date of Patent: Sep. 10, 1991

[54] APPARATUS FOR REMOVING STATIC ELECTRICITY FROM CHARGED ARTICLES EXISTING IN CLEAN SPACE

[75] Inventors: Soichiro Sakata; Takanori Yoshida, both of Kanagawa; Takao Okada, Tokyo, all of Japan

[73] Assignee: Takasago Thermal Engineering Co., Ltd., Tokyo, Japan

[21] Appl. No.: 427,682

[22] Filed: Oct. 13, 1989

[30] Foreign Application Priority Data

Mar. 7, 1989 [JP] Japan ..... 64-52867

[51] Int. Cl.[5] ..... H05F 3/04

[52] U.S. Cl. ..... 361/231; 361/216; 361/235

[58] Field of Search ..... 361/231, 216, 235, 213

[56] References Cited

U.S. PATENT DOCUMENTS

| | | | |
|---|---|---|---|
| 3,337,784 | 8/1967 | Lueder | 361/231 |
| 4,642,728 | 2/1987 | Unger | 361/231 |
| 4,757,422 | 7/1988 | Bossard et al. | 361/231 |
| 4,864,459 | 9/1989 | Larigaldie et al. | 361/216 |

OTHER PUBLICATIONS

"Application of Microporous Glass (MPG) for Cleaning Particles in Gas and Liquid"; Swiss Contamination Control 3 (1990) Nr. 4*a*, pp. 187–190, ICCS90/Zurich, Switzerland 10–14 Sep. 1990, Proceedings vol. I.

10th International Symposium on Contamination Control (ICCCS 90), Zurich, Switzerland, 10–14 Sep. 1990 "Contamination-Fire Ionizer for Static Control in Superclean Rooms", Sakata et al., pp. 60–63.

*Primary Examiner*—A. D. Pellinen
*Assistant Examiner*—Jeffrey A. Gaffin
*Attorney, Agent, or Firm*—Wenderoth, Lind & Ponack

[57] ABSTRACT

An apparatus for removing static electricity from charged articles existing in a clean space, particularly in a clean room for the production of semiconductor devices, includes an AC ionizer having a plurality of needle-like emitters disposed in a flow of clean air. A discharge end of each emitter is coated with a dielectric ceramic material. Opposite conductors are also included which are respectively positiond apart from each emitter by a predetermined distance. A DC voltage (or voltages) is applied to the opposite conductors. By adjusting the DC voltage (or voltages), the positive and negative ion concentration generated by each emitter is controlled. Further, a bias voltage may be added to the DC to increase the ion concentration.

15 Claims, 15 Drawing Sheets

APPARATUS FOR REMOVING STATIC ELECTRICITY FROM CHARGED ARTICLES EXISTING IN CLEAN SPACE

BACKGROUND OF THE INVENTION

1. Field of the Invention.

The present invention relates to the production of semiconductor elements in clean rooms, and more particularly, to an apparatus for dealing with the various difficulties caused by static electrification. Such difficulties include breakdown and performance deterioration of semiconductor devices, surface contamination of products due to absorption of fine particles and operational faults of electronic instruments located in such clean rooms.

2. Description of the Related Art.

As high integration, high speed calculation and energy conservation are promoted in semiconductor devices, the oxide insulation films of semiconductor elements have become thinner and the circuits and metal electrodes of such elements have been miniaturized, and thus, static discharge frequently causes pit formations in the elements and/or fusion or evaporation of metallic parts of the elements, leading to breakdown and performance deterioration of the semiconductor devices produced. For example, some MOS-FET and GaAs devices cannot withstand a voltage as low as 100 to 200 volts, and thus, it is frequently necessary to maintain the surface voltage of such semiconductor material elements at about 20 volts or lower. When semiconductor elements have completely broken down, the defect may be detected upon delivery examination. It is, however, very difficult to identify performance deterioration of such elements. In order to reduce static electricity related difficulties, the objective is to reduce to the extent possible the exposure of semiconductors to static electricity, that is, to prevent charged articles from approaching the semiconductor elements, and to neutralize all such charged articles. However, using prior art technology, it has not been possible to completely achieve such an objective. Examples of surface voltage measurements of various articles involved in the production of semiconductor devices include 5 kV for a wafer, 35 kV for a wafer carrier, 8 kV for an acrylic cover, 10 kV for a table surface, 30 kV for a storage cabinet, 10 kV for the technician's garments and 1.5 kV for a quartz palette.

Recent super clean room technology has made it possible to realize a flow of supplied clean air containing no particles having a diameter of 0.03 μm or more. However, fine particles are inevitably generated from the presence of operators, robots and various manufacturing apparatus located in the clean rooms. Such internally generated particles may have a diameter in the range of 0.1 μm to several tens of μm, and when such particles are deposited on the wafers of LSI and VLSE devices having a minimum line distance which is as small as 1 μm, the result is faulty products which reduces the production yield. It has been recently established that the deposition of fine particles on wafers is primarily attributed to electrostatic attraction and that the particular air flow patterns in the vicinity of the wafers is substantially unrelated to such deposition. Accordingly, prevention of such surface contamination of products due to the deposition of fine particles may only be achieved by the development of a technology for removing static electricity which does not directly relate to the technology for enhancing the cleanliness of clean rooms.

Furthermore, in the case wherein electronic equipment is located in the clean room, discharge currents created by the discharge of charged articles, for example charged human bodies and charged sheets of printer paper, may create static noise causing faults in the operation of the electronic equipment. To avoid such operational faults it is desired that the static electricity of charged articles existing in the clean room be eliminated.

To eliminate the above-discussed various difficulties caused by static electrification in the clean room, it is effective to neutralize the charged articles existing in the clean room. In cases where the charged articles are electrically conductive, neutralization can be carried out by simply grounding the charged articles so that static charges can be rapidly removed. However, from a practical standpoint it is impossible to ground all charged articles existing in the clean room, and in cases where the charged articles are insulators, they cannot be neutralized by grounding. As for wafers, although they are themselves conductive, they are transported and handled in cassette cases or palettes which are insulating. Accordingly, it is difficult to neutralize wafers by grounding. For these reasons, there have been proposed systems for removing static electricity which employ ionizers.

The underlying principle of such ionizer systems is as follows. In a clean room, air particles are removed by passing the air through filters in a flow direction, which is substantially one direction. An ionizer for ionizing air by corona discharge (ion generator) is disposed upstream the flow of clean air (normally in the vicinity of the air exhaling surfaces of the filters) to provide a flow of ionized air, which comes in contact with the charged articles to neutralize static electricity on the charged articles. Thus, positively and negatively charged articles are neutralized by negatively and positively ionized air, respectively.

Three general types of corona discharge ionizers are known—the pulsed DC type ionizers, the DC type and the AC type ionizers. In such ionizers, emitters are disposed in an air space and a high DC or AC voltage is applied to each emitter so that an electric filed of an intensity higher than the dielectric breakdown voltage of air is created in the vicinity of the emitter, thereby effecting corona discharge. The known types of air ionizers will now be described in some detail below.

Pulse DC type. As is diagrammatically shown in FIG. 17, direct currents having, for example, voltages of +13 kV to +20 kV and −13 kV to −20 kV, respectively, are alternately applied at a given time interval (e.g. from 1 to 11 seconds) to a pair of needle-like emitters (tungsten electrodes) 100*a* and 100*b* disposed spaced from each other by a predetermined distance (for example several tens of cm), whereby positive and negative air ions are alternately generated from each of the emitters 100*a* and 100*b*. The ions so generated are carried by air flow to a charged article 101 to neutralize static charges of opposite polarity on the article 101. An example of the DC pulse applied to the emitters is shown in FIG. 18.

DC type. As is diagrammatically shown in FIG. 19, a pair of insulator coated electrically conductive bars 102*a* and 102*b* respectively having a plurality of emitters 103*a* and 103*b* extending therefrom at 1 to 2 cm intervals, are disposed parallel to each other with a predetermined distance (for example several tens of cm) therebetween. A positive DC voltage (e.g. +12 to +30 kV) is applied to the emitters 103*a* of the bar 102*a*, while a negative DC voltage ((e.g. from −12 to −30 kV) is applied to the emitters 103*b* of the bar 102*b*, thereby ionizing air.

AC type. An AC high voltage of a commercial frequency of 50/60 Hz is applied to needle-like emitters. As is diagrammatically shown in FIG. 20, a plurality of emitters 104 are arranged in a two dimensional expanse and connected to a high voltage AC source 105 via a frame work of conductive bars 106 having insulating coatings. For each emitter, a grounded grid 107 is disposed as an opposite conductor so that the grid 107 surrounds the discharge end of the emitter 104 with a space therebetween. When the high voltage AC is applied to emitter 104, there is formed an electric field between the emitter 104 and the grounded grid 107. This electric field inverts its polarity in accordance with the cycle of the applied AC, whereby positive and negative ions are generated from the emitter 104.

All such known types of ionizers pose various problems, as noted below, when they are employed to neutralize charged articles in a clean room.

Firstly, the emitters themselves contaminate the clean room. It is said that tungsten is the most preferred material for the emitter. When a high voltage is applied to the tungsten emitter to effect corona discharge, a great deal of fine particles (almost all of them having a diameter of 0.1 μm or less) are sputtered from the discharge end of the emitter upon generation of positive ions, and are carried by the flow of the clean air to thereby contaminate the clean room. Furthermore, since the discharge end of the emitter is damaged by the sputtering, the emitter must frequently be replaced.

Secondly, when an ionizer is made to operate for a prolonged period of time in a clean room, white particulate dust (primarily comprised of $SiO_2$) deposits and accumulates on the discharge end of the emitter to the extent that it may be visible. While the cause of such white particulate dust is believed to be attributed to the material constituting the filters, the deposition and accumulation of the particulate dust on the discharge end of the emitter poses a problem in that ion generation is reduced and contamination is increased due to scattering of the dust. Accordingly, the emitter must frequently be cleaned.

Thirdly, a plurality of emitters disposed on the ceiling of the clean room may increase the concentration of ozone in the clean room. Although the increased ozone concentration is not especially harmful to humans, ozone is reactive and undesirable in the production of semiconductor devices.

In addition to the above-discussed common problems, the individual types of known ionizers involve the following problems.

With DC type ionizers, in which some emitters (emitters 103*a* on the bar 102*a* in the example shown in FIG. 19) generate positive ions, while the other emitters (emitters 103*b* on the bar 102*b* in the example shown in FIG. 19) generate negative ions, and in which such ions are carried by the air flow, frequently there is an imbalance in the number of positive or negative ions which arrive at a charged article. The charged article often receives only ions having the same polarity as that of the static charge thereon. In this case the charged article is not neutralized. On the contrary, an uncharged article or slightly charged article may experience an increased charge as a result of the ions carried thereto. While such a phenomena is likely to occur in the case where the distance between the electrodes (the distance between the rods 102*a* and 102*b* in the example shown in FIG. 19) is fairly large, if the distance is made short to counter this problem, a new problem of sparking is posed.

With pulsed DC type ionizers in which the polarity of the ions is reversed at a predetermined interval, positive and negative ions are alternately supplied to the charged article. Accordingly, the condition in which an imbalance of positive or negative ions is continuously supplied to the charged article, as is the case with the DC type ionizers, is avoided. However, if the pulse period is short there is an increased possibility that the positive and negative ions will intermix in the air flow and thus disappear before they reach the charged article. To the contrary, if the pulse period is long, although the possibility that the ions will disappear is decreased, large masses of positive and negative ions will alternately arrive at the charged article. It is reported by Blitshteyn et al. in Assessing The Effectiveness of Cleanroom Ionization Systems, Microcontamination, March 1985, pages 46–52, 76 that with pulsed DC type ionizers, the potential of a charged surface decays in a zigzag manner, for example, as shown in FIG. 21. According to this report, static electricity on a charged surface does not disappear, rather static loads of about +500 volts and about −500 volts alternately appear on the charged surface. Such a large surface potential may reduced the production yield since recent super LSI devices may be damaged even by a surface potential on the order of several tens of volts.

AC type ionizers suffer from an imbalance in the number of generated positive ions and the number of generated negative ions. Frequently, the number of positive ions generated is more than ten times the number of negative ions generated. Shown in FIG. 22 are measurement results reported by M. Suzuki et al. depicting the densities of the positive and negative ions generated by an AC type ionizer. See the Japanese language literature, Proceedings of The 6th. Annual Meeting for Study of Air Cleaning and Contamination Control, (1987) pages 269–276, and the Corresponding English language literature, M. Suzuki et al., Effectiveness of Air Ionization Systems in Clean Rooms, 1988 Proceedings of The IES Annual Technical Meeting, Institute of Environmental Sciences, Mt. Prospect, Ill., pages 405 to 412. As seen from FIG. 22, the density of negative ions is markedly lower than that of positive ions. The measurement as shown in FIG. 22 was made with an AC type ionizer installed in a space wherein clean air was caused to flow downwards in a vertical direction from horizontally disposed HEPA filters. In FIG. 22, a reference symbol "d" designates a vertical distance extending from the point where the measurement was carried out to the emitter points, a reference symbol "l" designates a horizontal distance extending from the point where the measurement was carried out to a vertical line passing through a central point of the ionizer, and the BACKGROUND data denote the positive and negative ion densities of the air flow when the ionizer was OFF. With the conventional AC type ionizers supplying positive ion rich air, the charged surface is not neutralized, rather it may remain positively charged at a potential on the order of several tens of volts to about +200 volts.

SUMMARY OF THE INVENTION

Accordingly, an object of the present invention is to provide an apparatus for removing static electricity from charged articles existing in a clean room, particularly a clean room for the production of semiconductor devices. Particularly, the invention aims to solve the above-discussed problem of ion imbalance associated with known AC type ionizers, as well as the above-discussed problems common to known ionizers, that is, the contamination of clean rooms due to emitter sputtering, the deposition and accumulation of particulate dust on emitters and the generation of ozone.

The above and other objects are achieved by an apparatus for removing static electricity from charged articles existing in a clean space according to the present invention. Such an apparatus includes an AC ionizer having a plurality of needle-like emitters disposed in the flow of filtered clean air, wherein an AC high voltage is applied to the emitters to effect corona discharge for ionizing air, and whereby a flow of ionized air is supplied to the charged articles to neutralize the static electricity thereof. The apparatus is characterized in that a discharge end of each of the needle-like emitters is coated with a dielectric ceramic material, in that each of the emitters is disposed with its discharge end spaced apart by a predetermined distance from a grid-like or loop-like opposite conductor to form a discharge pair, in that a plurality of such discharge pairs are arranged in a two dimensional expanse in a direction which transverses the flow direction of the clean air, in that each opposite conductor of the discharge pairs is connected to a DC voltage source, and in that there is provided a means for adjusting a DC voltage output from the DC voltage source.

We have found that by coating a discharge end of the needle-like emitters with a thin film of dielectric ceramic material, dust generation from the discharge end upon corona discharge in response to the application of an AC high voltage can be minimized without substantially lowering the ionizing ability of the emitter, and that when such an emitter having the discharge end coated with a ceramic material is used in a clean room, not only can the deposition of particulate dust on the discharge end be avoided, but also the ozone generation in the clean room can be minimized. Suitable dielectric ceramic materials which can be used herein include, for example, quartz, alumina, alumina-silica and heat resistant glass. Of these, quartz, in particular transparent quartz, is preferred. The thickness of the ceramic coating on the discharge end of the emitter is suitably 2 mm or less. In the case of transparent quartz, the thickness is preferably 0.05 to 0.5 mm. Incidentally, if a DC high voltage is applied to such an emitter having the discharge end coated with a ceramic material, air can be ionized by an electric field generated at the discharge end of the emitter during the moment of application of the DC high voltage. However, after the lapse of a particular time period (for example 0.1 second in an air flow of 0.3 m/sec), ions of a polarity opposite to that of the applied voltage surround the emitter to weaken the electric field at the discharge end of the emitter, whereby generation of ions is no longer continued. Accordingly, it is necessary to use an AC high voltage.

We have also found that the basic problem of the imbalance in the positive and negative ion densities associated with AC type ionizers can be solved by applying a predetermined DC voltage or voltages to the opposite conductors. The discharge end of each emitter is preferably positioned a predetermined distance upstream from the corresponding grid-like or loop-like opposite conductor with respect to the flow of air. While it is essential in the apparatus according to the present invention to suitably select an intensity of the DC voltage, or the intensities of the voltages, to be applied to the opposite conductors, there are roughly classified two systems for applying the DC voltage to each opposite conductor in order to realize a supply of ionized air having a balance in positive and negative ion densities. In the first system, a DC voltage adjusted at a predetermined intensity is applied from a common DC source to the opposite conductors of all of the discharge pairs having substantially the same configuration and structure. According to the first system, positive and negative ions are generated from each discharge pair at substantially the same density, and alternately at periodic intervals corresponding to a frequency of the AC voltage applied to the emitters. According to the second system, some discharge pairs continuously generate a high concentration of positive ions but do not substantially generate negative ions, while the other discharge pairs continuously generation a high concentration of negative ions but do not substantially generate positive ions. In the second system, a DC voltage of a certain intensity is applied to the discharge pairs which generate positive ions, while a DC voltage of a different intensity is applied to the discharge pairs which generate negative ions, and the positive ion generating discharge pairs and the negative ion generating discharge pairs are arranged in a two dimensional expanse at an appropriate distribution in a direction transversing of the flow direction of the clean air, whereby ionized air having a balance in positive and negative ion densities may be supplied to the charged articles existing downstream of the air flow.

We have further found that in addition to the application of a DC voltage or voltages to the opposite conductors, if an appropriate positively or negatively biased DC voltage is added to the AC voltage applied to the emitters, positive and negative ions can be generated in higher concentrations.

Thus, the present invention provides an apparatus for removing static electricity from charged articles existing in a clean space and includes an AC ionizer having a plurality of needle-like emitters disposed in a flow of filter clean air, wherein an AC high voltage is applied to the emitters to effect corona discharge for ionizing air and a flow of thus ionized air is supplied onto the charged articles to neutralize static electricity thereon, wherein a discharge end of each of the needle-like emitters is coated with a dielectric ceramic material, wherein each of the emitters is disposed with its discharge end spaced apart by a predetermined distance from a grid-like or loop-like opposite conductor to form a discharge pair, wherein a plurality of such discharge pairs are arranged in a two dimensional expanse in a direction transversing, preferably perpendicular to, the flow direction of clean air, (a) wherein opposite conductors of the discharge pairs are connected to a common DC voltage source, and wherein there is provided a means for adjusting a DC voltage output from the DC voltage source so that each of the discharge pairs may ionize air to provide balanced positive and negative ion densities; or (b) wherein opposite conductors of some of the discharge pairs are connected to a first DC voltage source, while opposite conductors of the other discharge pairs are connected to a second DC voltage source, and wherein there is provided a means for independently adjusting DC voltage outputs of the first and second DC voltage sources so that the discharge pairs connected to the first DC voltage source may generate ions inclined to a positive or negative polarity, while the discharge pairs connected to the second DC voltage source may generate ions inclined to the opposite polarity; or (c) wherein each opposite conductor of the discharge pairs is connected to a DC voltage source, wherein there is provided a means for adjusting a DC voltage output of the DC voltage source, wherein each emitter of the discharge pairs is connected to high voltage AC source having added thereto a positive or negative bias voltage, and wherein there is provided a means for adjusting an intensity of the voltage output from the AC source and an intensity and polarity of the bias voltage.

BRIEF DESCRIPTION OF THE DRAWINGS

The invention will be desCribed in detail with reference to the attached drawings in which.

DETAILED DESCRIPTION OF THE PREFERRED EMBODIMENTS

Figure 1:
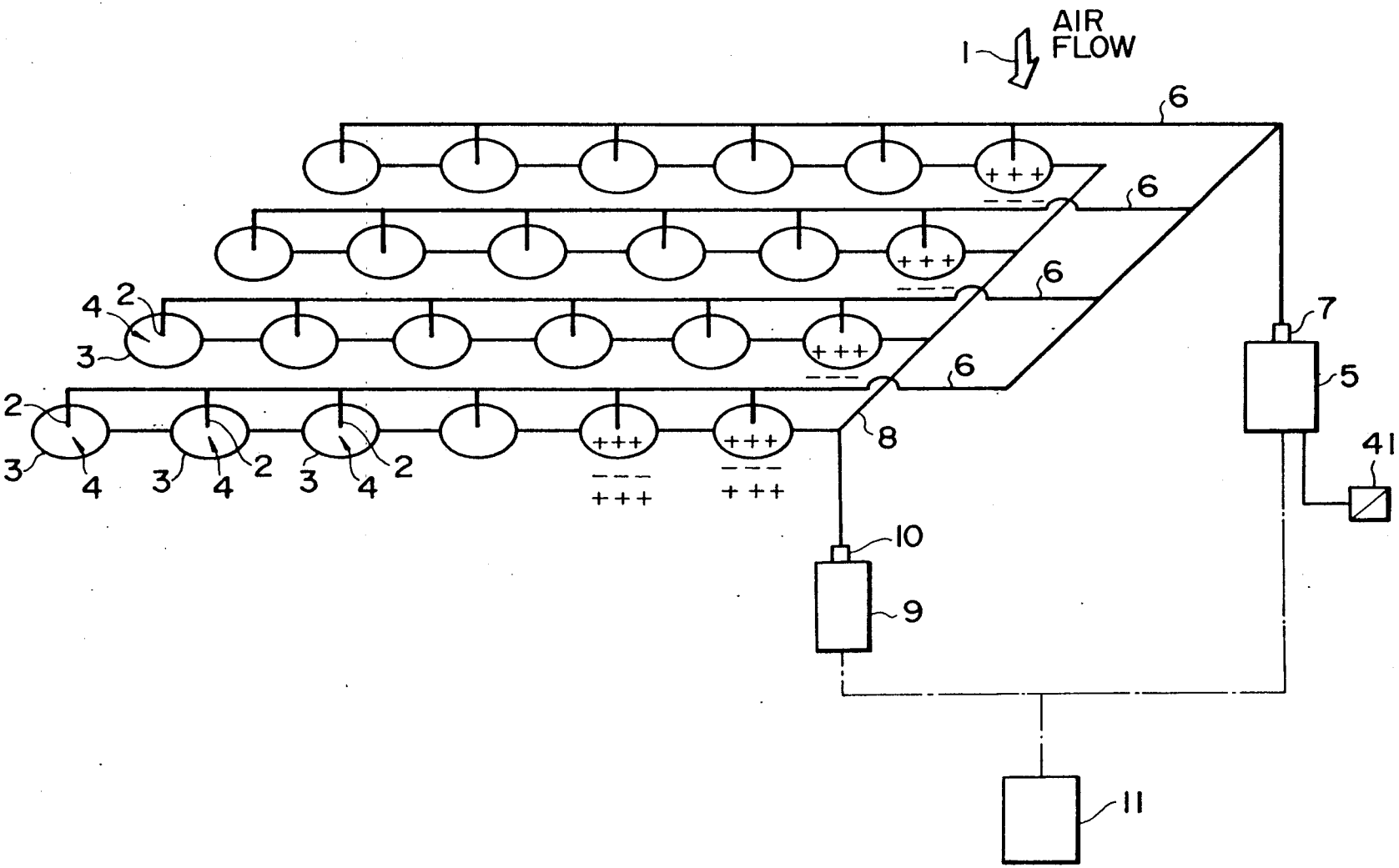
FIG. 1 is a schematic perspective view of an example of an air ionizer which may be used according to the apparatus of the present invention.

FIG. 1 schematically depicts an example of an air ionizer which may be used in the apparatus according to the present invention. The ionizer includes a plurality of discharge pairs 4 which are each made up of a needle-like emitter 2 and a loop-shaped opposite conductor 3. The discharge pairs 4 are arranged in a two dimensional expanse in a direction transversing a flow direction 1 of clean air. HEPA or ULPA filters (not shown) are disposed upstream of the discharge pairs 4 such that air that is cleaned by the filters passes through the discharge pairs 4. A unidirectional air flow which has passed through the discharge pairs 4 is directed toward the charged articles. In the illustrated example, each needle-like emitter 2 is disposed with its end extending in the downstream direction of the air flow, and each ring-shaped opposite conductor 3 is located transversing the air flow. The end of the emitter 2 is positioned on or about an imaginary vertical line passing through the center of the ring of the opposite conductor 3. All the emitters 2 are connected through a common insulated conductive line 6 to an output terminal 7 of an AC voltage controlling device 5, which controls an AC voltage applied to the emitters 2. All of the opposite conductors 3 are connected through a common insulated conductive line 8 to an output terminal 10 of a DC voltage controlling device 9, which controls a DC voltage applied to the opposite conductors 3. A reference numeral 11 designates a voltage operating part for adjusting output voltages of the AC voltage controlling device 5 and the DC voltage controlling device 9.

Figure 2:
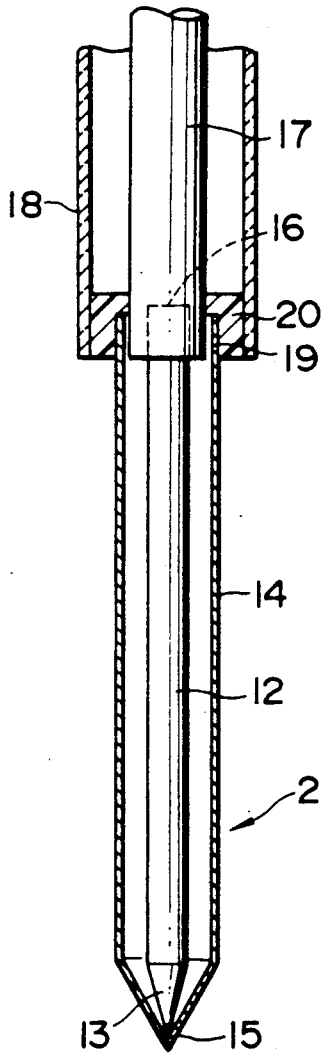
FIG. 2 is a cross-sectional view of an example of an emitter which may be used in the ionizer of FIG. 1.
Figure 3:
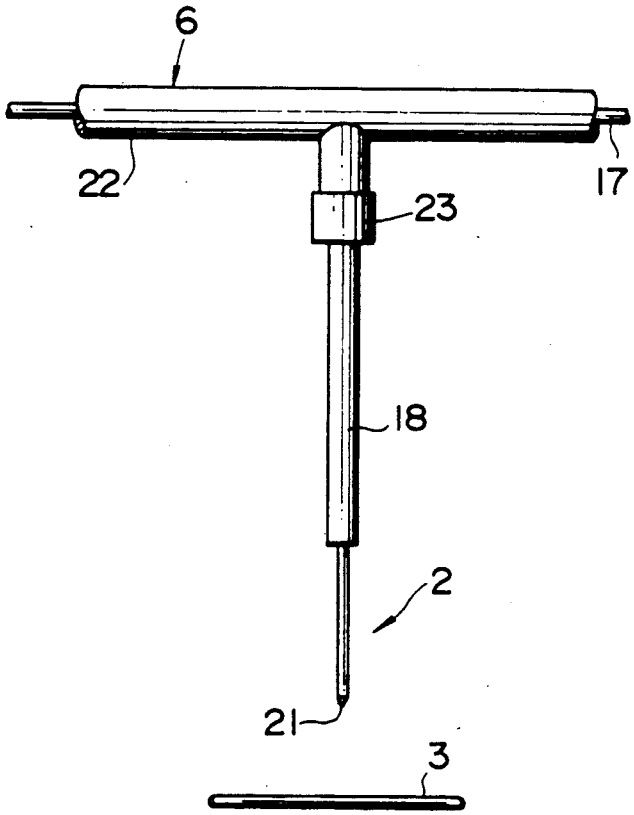
FIG. 3 is an enlarged side view showing an emitter and opposite conductor pair used in the ionizer of FIG. 1.

FIG. 2 is a cross-sectional view of an example of the emitter 2. The emitter used herein is characterized in that its discharge end is coated with a dielectric ceramic material. The emitter illustrated in FIG. 2 comprises a tungsten rod 12 having a tapered needle portion 13 at one end and a tube 14 of a ceramic material concentrically containing the tungsten rod 12. The ceramic tube 14 also has a sealed tapered end portion 15. The tungsten rod 12 is placed so that the end of its tapered needle portion 13 comes in contact with an inner surface of the tapered end portion 15 of the ceramic tube 14, whereby the tapered needle portion 13 of the tungsten rod 12 is coated with the thin ceramic tube 14. In the example shown in FIG. 2, the outer diameter of the tungsten rod 12 is slightly smaller than the inner diameter of the ceramic tube 14, and the tapered needle portion 13 of the tungsten rod 12 tapers at an angle which is more acute than that of the tapered end portion 15 of the ceramic tube 14. Thus, by encapsulating the tungsten rod 12 with the ceramic tube 14 so that the tapered needle portion 13 of the former contacts the tapered end portion 15 of the latter, the center of the end of the tapered needle portion 13 of the tungsten rod 12 may be naturally fitted to the center of the inside surface of the tapered end portion 15 of the ceramic tube 14. The other end 16 of the tungsten rod 12 is jointed to a metallic conductor 17. This joint is made by intimately and concentrically inserting a predetermined depth of the tungsten rod 12 at its end 16 into an end of a metallic rod 17 having a diameter larger than that of the tungsten rod 12. The metallic rod 17 is received in a tube 18 of an insulating material such as glass, to which the other end 19 of the ceramic tube 14 is also connected via a seal member 20. As shown in FIG. 3, the emitter 2 is positioned with its discharge end 21 having the ceramic cover spaced apart from the corresponding ring-shaped opposite conductor ring 3. This positioning is made by suspendedly supporting the emitters 2 on an insulated conductor 6 which is sufficiently rigid to support the emitters 2 and thus in itself serves as a frame member for supporting the emitters. The insulated conductor 6 may include a relatively thick metallic conductor 17 coated with an insulating resin 22 (for example, fluorine resins such as "Teflon"), and also serves as a frame member for supporting opposite conductors 3 via insulating supporting members. By connecting the emitters 2 to the insulated conductor 6 via respective joint members 23 at intended positions, the emitters 2 can be arranged in the air flow without significantly disturbing the air flow.

Figure 4:
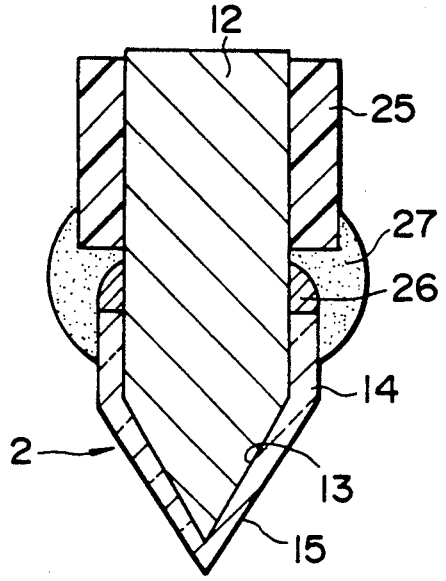
FIG. 4 is a cross-sectional view of another example of an emitter which may be used in the ionizer of FIG. 1.
Figure 5:
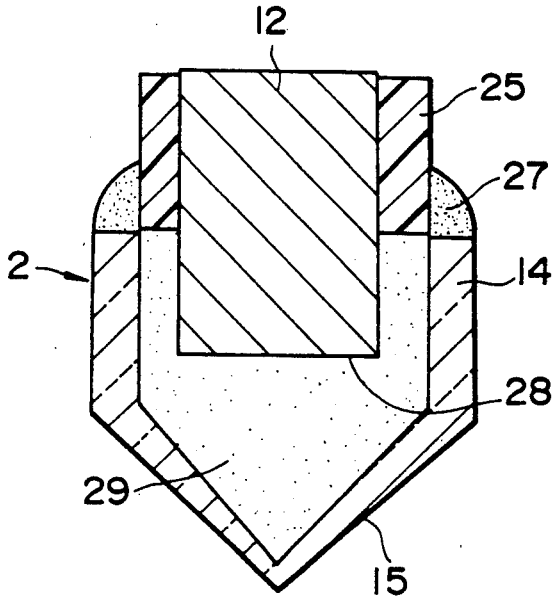
FIG. 5 is a cross-sectional view of a further example of an emitter which may be used in the ionizer of FIG. 1.

The emitter 2 used herein should have its discharge end 21 coated with a dielectric ceramic material. Examples of such dielectric ceramic material include, for example, quartz, alumina, alumina-silica and heat resistant glass. Of these, quartz, in particular transparent quartz, is preferred. The thickness of the ceramic coating on the needle portion 13 of the tungsten rod 12 is suitably 2 mm or less, preferably 0.05 to 0.5 mm. The ceramic coating should also have a tapered end portion (an acute end 15 as shown in FIG. 2). Portions of the tungsten rod 12 other than the needle portion which do not normally act as a discharge location, such as a body portion of the tungsten rod 12, are not necessarily coated with a ceramic material. Such examples are shown in FIGS. 4 and 5. FIG. 4 depicts a tungsten rod 12 with its tapered end coated with a ceramic tube 14. Namely, the needle portion 13 of the tungsten rod 12 is coated with the tapered end portion 15 of the ceramic tube 14, and the body portion of the tungsten rod 12 is coated with another insulating material (e.g. an insulating resin) 25. The ceramic tube 14 is bonded to the tungsten rod 12 by means of an adhesive 26 (e.g. an epoxy resin based adhesive), and the bond portion is covered with a sealing agent 27 (e.g. a silicone sealing agent) so that the tungsten may not be exposed. In this example, where is no spacing between the outer surface of the tapered needle portion 13 of the tungsten rod 12 and the inner surface of the tapered end portion 15 of the ceramic tube 14. FIG. 5 depicts an example in which a conductive adhesive 29 is located between an end 28 of the tungsten rod 12 and the tapered end portion 15 of the ceramic tube 14. Namely, the end 28 of the tungsten rod 12 extending beyond the insulating coating 25 is covered by the ceramic tube 14 having the tapered end portion 15 to define a void therebetween, and the void is filled with the conductive adhesive 29. A reference numeral 27 designates a sealing agent, as in the case with FIG. 4. Examples of the conductive adhesive 29 which can be used herein include, for example, a dispersion of particulate silver in an epoxy adhesive and a colloidal dispersion of graphite in an adhesive. In the example shown in FIG. 5, the end 28 of the tungsten rod 12 may or may not be pointed.

Figure 6:
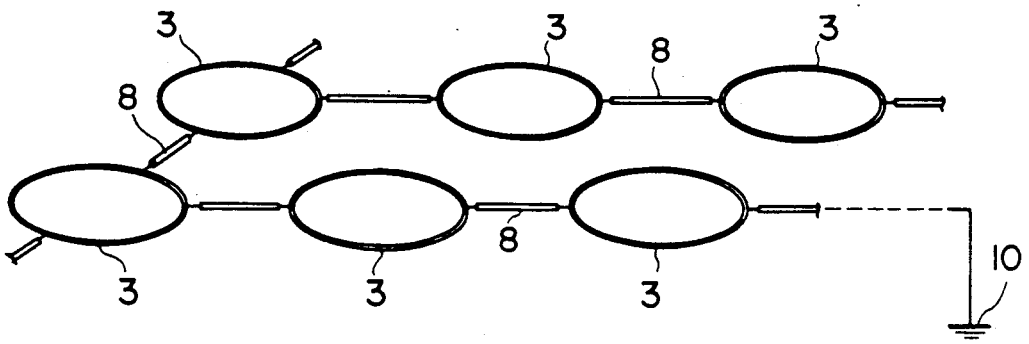
FIG. 6 is a perspective view showing loop-shaped opposite conductors which may be used in the ionizer of FIG. 1.

FIG. 6 is an enlarged perspective view showing several of the loop-shaped opposite conductors 3 of FIG. 1. In this example, each opposite conductor 3 comprises a metal ring, and a required number of such rings are connected together at a predetermined interval by a conductor 8 having an insulating coating so that they may be installed substantially within a same plane of a two dimensional expanse. The conductor 8 is sufficiently rigid to hold the position of the ring-shaped opposite conductors 3 in position, and thus serves as a frame support for the opposite conductors 3. All of the ring-shaped opposite conductors 3 are connected through the conductor 8 with the output 10 of the DC voltage controlling device 9. The opposite conductors 3 are preferably shaped as a perfect circle as illustrated herein. However, they may form an ellipse or a polygon. Alternatively, they may be grids as in conventional AC type ionizers formed by perpendicularly intersecting a plurality of straight lines within a plane. In any event, the opposite conductor 3 is not coated with a ceramic material, and is used with the metal surface thereof exposed.

Figure 7:
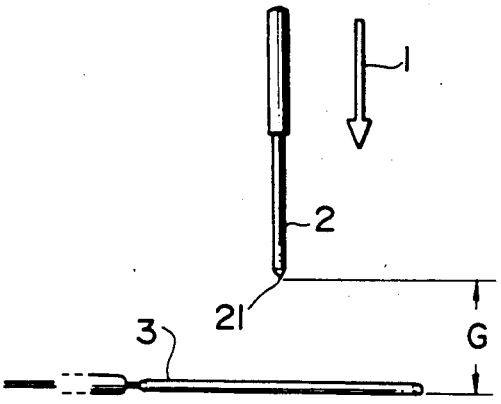
FIG. 7 is a side view showing an example of the relative position of an emitter and the corresponding opposite conductor used in the ionizer of FIG. 1.
Figure 8:
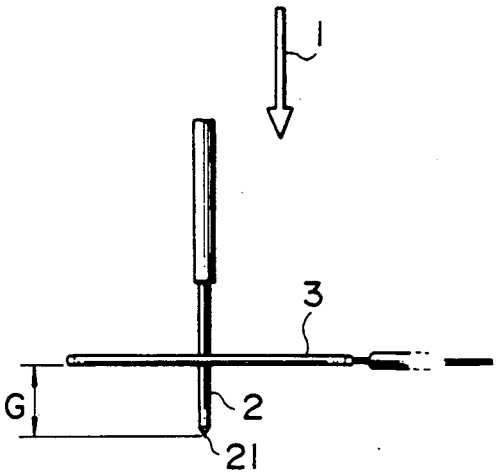
FIG. 8 is a side view showing another example of the relative position of an emitter and the corresponding opposite conductor used in the ionizer of FIG. 1.

FIGS. 7 and 8 show examples of the relative position of the emitter 2 and the corresponding opposite conductor 3, which constitute the discharge pair 4. In both the examples, the emitter 2 and the opposite conductor 3 are installed along the air flow direction 1 and transversing the air flow direction 1, respectively, so that the emitter is positioned on or about an imaginary vertical line passing through the center of the opposite conductor 3. In the example of FIG. 7, the emitter 2 is installed with its discharge end 21 coated with a ceramic material positioned upstream of the opposite conductor 3 with respect to the air flow by a distance G. Whereas in the example of FIG. 8, the emitter 2 is installed with its discharge end 21 coated with a ceramic material positioned downstream of the opposite conductor 3 with respect to the air flow by a distance G. Namely, the emitter 2 extends through the ring of the opposite conductor 3 in the example of FIG. 8, whereas it does not do so in the example of FIG. 7. Which embodiment should be adapted is determined depending upon the conditions of the applying voltage, as described hereinafter.

Figure 9:
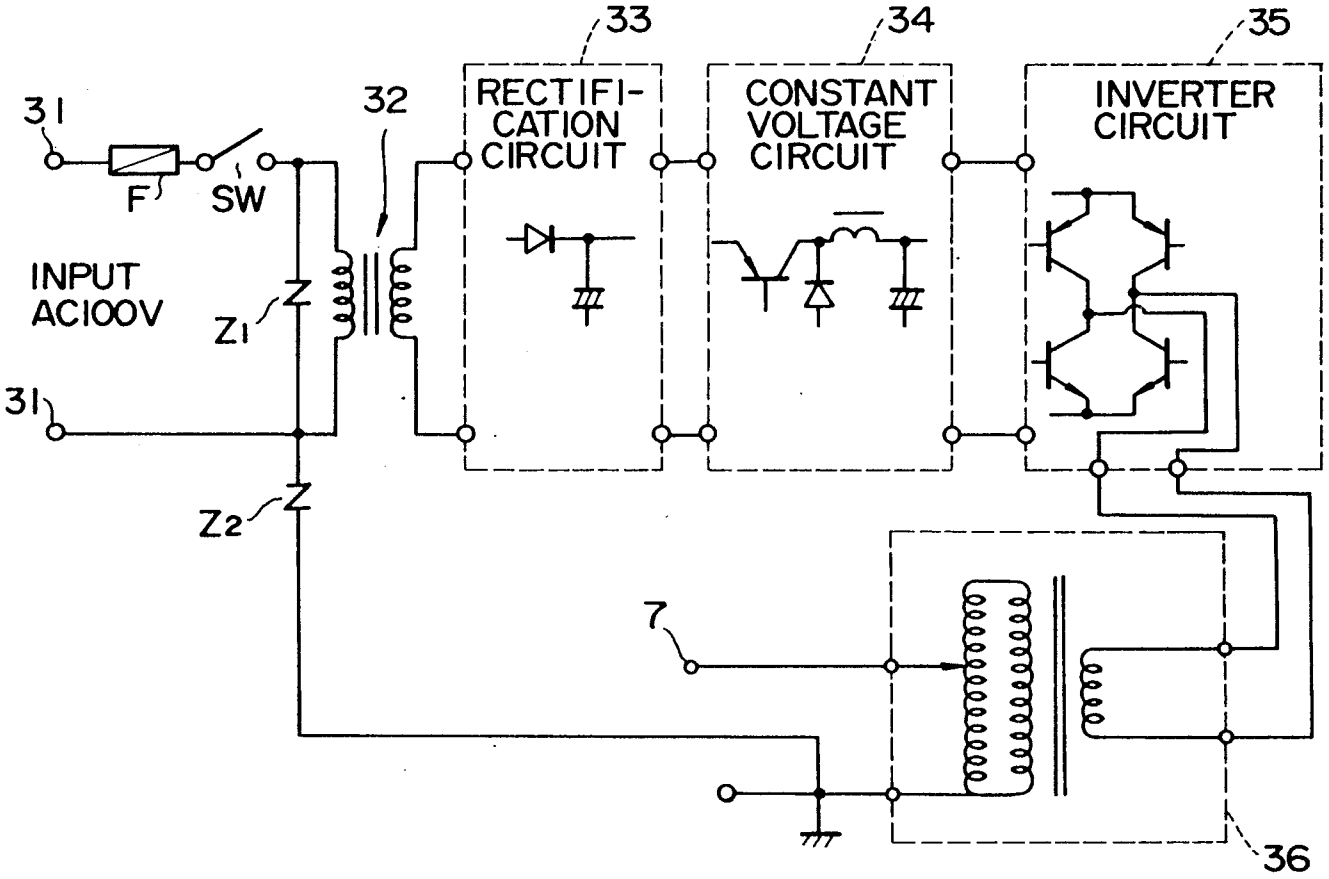
FIG. 9 is a diagram showing an example of a circuit for a voltage controlling device and it voltage operating part which may be used in the ionizer of FIG. 1.

FIG. 9 is a circuit diagram for the AC voltage controlling device 5 and its voltage operating part 11 which may be used in the ionizer of FIG. 1. The illustrated circuit assembly comprises an input terminal 31 for receiving commercial AC (100 V), a transformer 32 coupled to the input terminal 31, a rectification circuit 33, a constant voltage circuit 34, an inverter circuit 35 and a high voltage transformer 36 connected in series to the secondary side of the transformer 32. The AC from the transformer 32 undergoes full wave rectification in the rectification circuit 33, thus becoming DC. The constant voltage circuit 34 is to provide an output of a constant voltage. When the voltage of the commercial AC employed varies for some reason, the DC voltage from the rectification circuit 33 varies accordingly, and in turn the input voltage to the subsequent high voltage transformer 36 varies, and the eventual output voltage cannot be kept constant. Accordingly, the constant voltage circuit 34 is utilized. The inverter circuit 35 is incorporated with an oscillation circuit, and chops the constant DC voltage output from the constant voltage circuit 34 into a square wave, which is then transformed by the high voltage transformer 36 into a high AC voltage square wave signal which is output to the emitters 2 from the output terminal 7 (see FIG. 1). The high voltage transformer 36 includes an insulated transformer incorporated with a slide rheostat, and thus, the intensity of the AC voltage output to the emitters 2 can be controlled as desired by operating the slide rheostat of the high voltage transformer 36. Accordingly, this high voltage transformer 36 corresponds to the voltage operating part 11 of FIG. 1. In FIG. 9, a reference symbol F designates a fuse, SW a switch for the electric source, and $Z_1$ and $Z_2$ spark inhibitors for absorbing noise at the time of switching-on, thereby reducing the supply of a pulse component.

The DC voltage controlling device 9 of FIG. 1 may be a any known device for converting commercial AC to DC. It is sufficient that it can convert a commercial AC source of 100 V to a DC voltage of, for example, between −1 kV to +1 kV.

In the apparatus of FIG. 1, an AC high voltage is applied to all of the emitters 2 from the same AC voltage source, while a DC voltage is applied to all of the opposite conductors 3 from the same DC voltage source, and all of the discharge pairs 4 have substantially the same configuration and structure. Accordingly, when clean air flows uniformly through the discharge pairs 4, all the discharged pairs 4 exhibit the same characteristics when ionizing air. Namely, each discharge pair 4 alternately generates positive and negative ions at a periodic interval corresponding to a frequency of the AC applied to the emitters 2. If the DC voltage applied to the opposite conductors 3 is properly adjusted, it is possible to provide positive and negative ions having substantially the same density.

Figure 10:
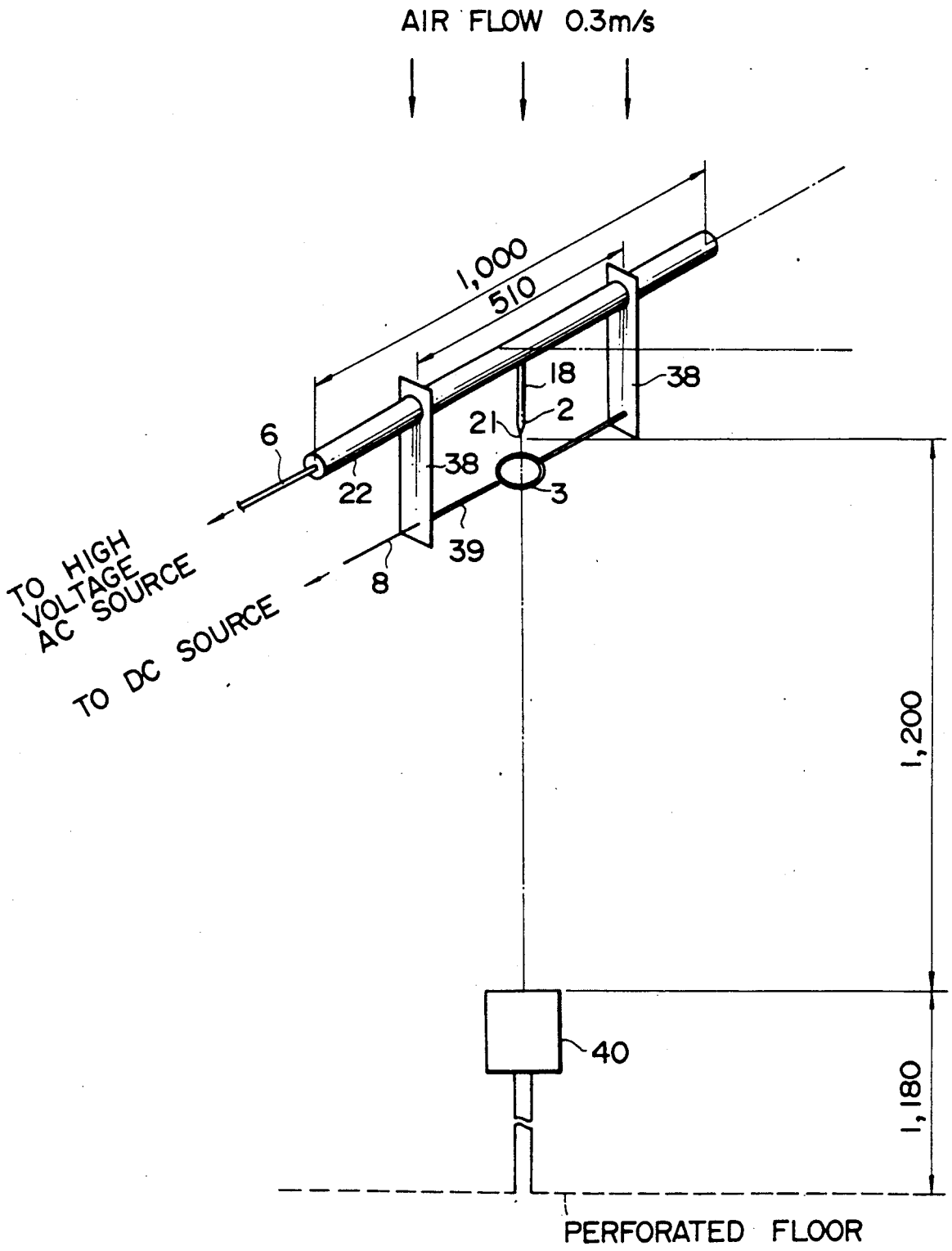
FIG. 10 illustrates a testing apparatus used herein.

The operation of the apparatus of FIG. 1 will be specifically described with reference to test examples. FIG. 10 illustrates the test setup used in the measurements. A single emitter 2 covered with quartz having the construction shown in FIG. 2 is disposed with its axis extending in a flow direction of clean air flowing downwards at rate of 0.3 m/sec in a vertical laminar flow clean room. The tungsten rod 12 of the emitter 2 has a diameter of 1.5 mm. The quartz tube 14 of the emitter 2 has an outer diameter of 3.0 mm and an inner diameter of 2.0 mm, and the length of tapered end portion 15 of the quartz tube 5 mm. The glass tube 18 of the emitter 2 has an outer diameter of 8 mm and an inner diameter of 6 mm, and contains the metallic conductor 17 of a 3 mm diameter passing therethrough. The emitter is electrically connected to the AC voltage controlling device 5 via the vertically extending glass tube 18 and the horizontally extending resin covered tube 22. An opposite conductor 3 including a stainless steel ring is disposed so that its imaginary vertical center line substantially coincides the axis of the emitter 2. The opposite conductor 3 is held in position by supporting the insulated conductive 39 using acrylic bars 38 vertically suspended from the resin covered tube 22. A conductive line 8 connected with the insulated conductive line 39 is connected to the DC voltage controlling device 9. A thickness of the stainless opposite conductor ring is 6 mm, and a diameter of the ring is 80 mm. A high voltage AC is applied to the emitter 2, while a DC voltage is applied to the opposite conductor 3, to effect corona discharge, and positive and negative ion densities (in $\times 10^3$ ions/cc) are measured at a location 1200 mm below the discharge end 21 of the emitter 2 using an ion density meter 40. An effective AC component of the applied AC to the emitter 2 and the DC voltage applied to the opposite conductor 3 are represented by V and $V_e$, respectively.

Figure 11:
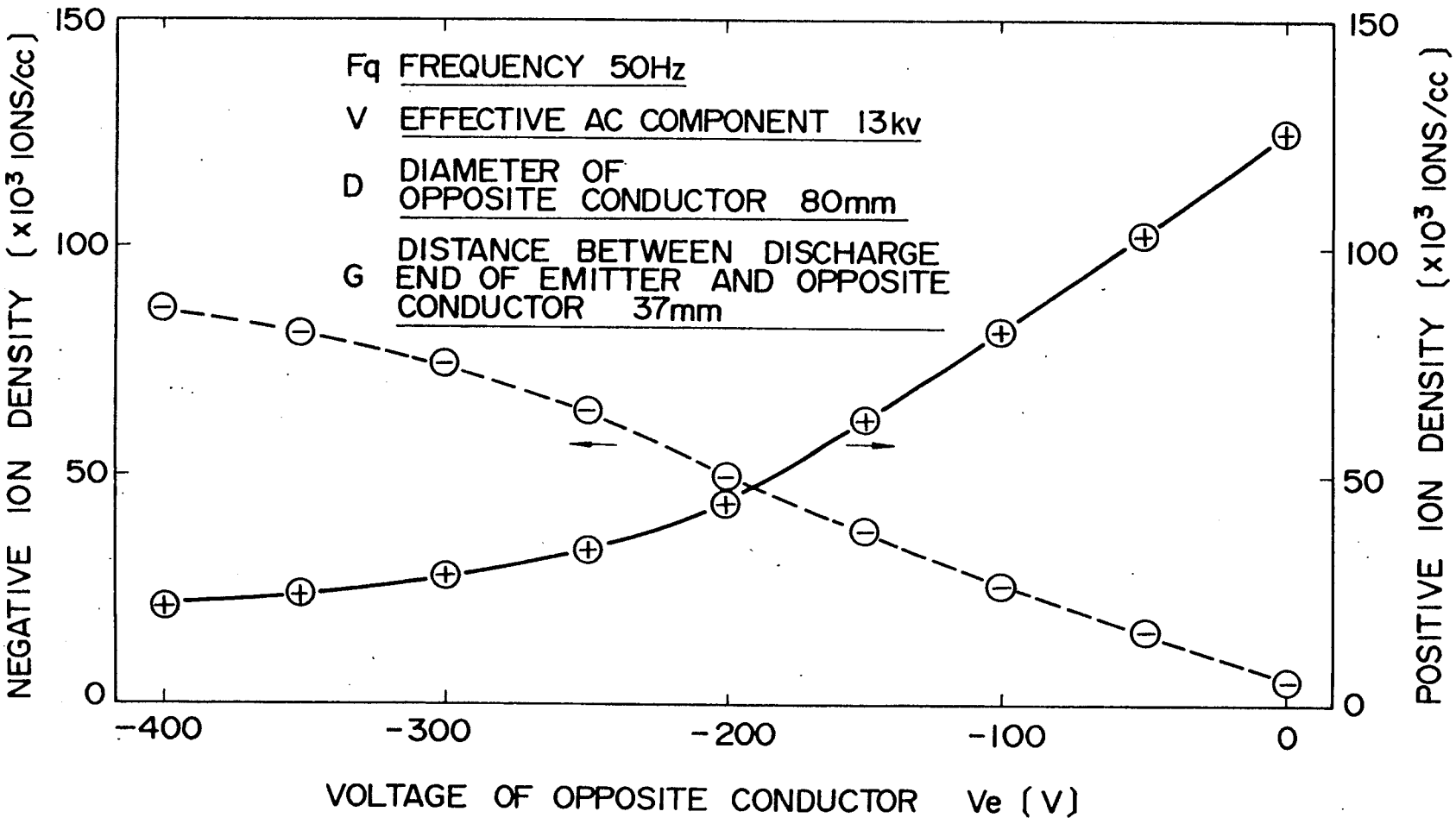
FIG. 11 is a graph showing measured positive and negative ion densities plotted against the DC voltage applied to the opposite conductor obtained in the test of FIG. 10 under the indicated conditions.

FIG. 11 is a graph showing positive and negative ion densities measured by the ion density meter 40 plotted against the DC voltage $V_e$ applied to the opposite conductor 3, where the distance of the discharge end 21 of the emitter 2 is 37 mm upstream from the opposite conductor 3 (G shown in FIG. 7 = +37 mm), where V = 13 kV and where a frequency of the applied AC is 50 Hz. The result shown in FIG. 11 is very interesting in that where no DC voltage is applied to the opposite conductor, the positive ion density is significantly higher than the negative ion density, resulting in ionized air having an excess number of positive ions, whereas if a negative DC voltage is applied to the opposite conductors, as the absolute magnitude of the applied negative DC voltage increases, the positive ion density decreases, while the negative ion density increases.

Under the test conditions employed, when $V_e$ is approximately −190 V, the number of positive and negative ions is balanced (each having a density of about $48 \times 10^3$ ions/cc). Accordingly, where the same conditions as those of this test are applied to each discharge pair of FIG. 1, if a DC voltage of approximately −190 V is applied to each opposite conductor, ionized air of substantially the same positive and negative ion densities will continuously flow downstream from the discharge pairs. In clean rooms an air flow is not significantly disturbed. Accordingly, ionized air having well balanced positive and negative ion densities may be made to flow downstream to impinge on charged articles.

Figure 12:
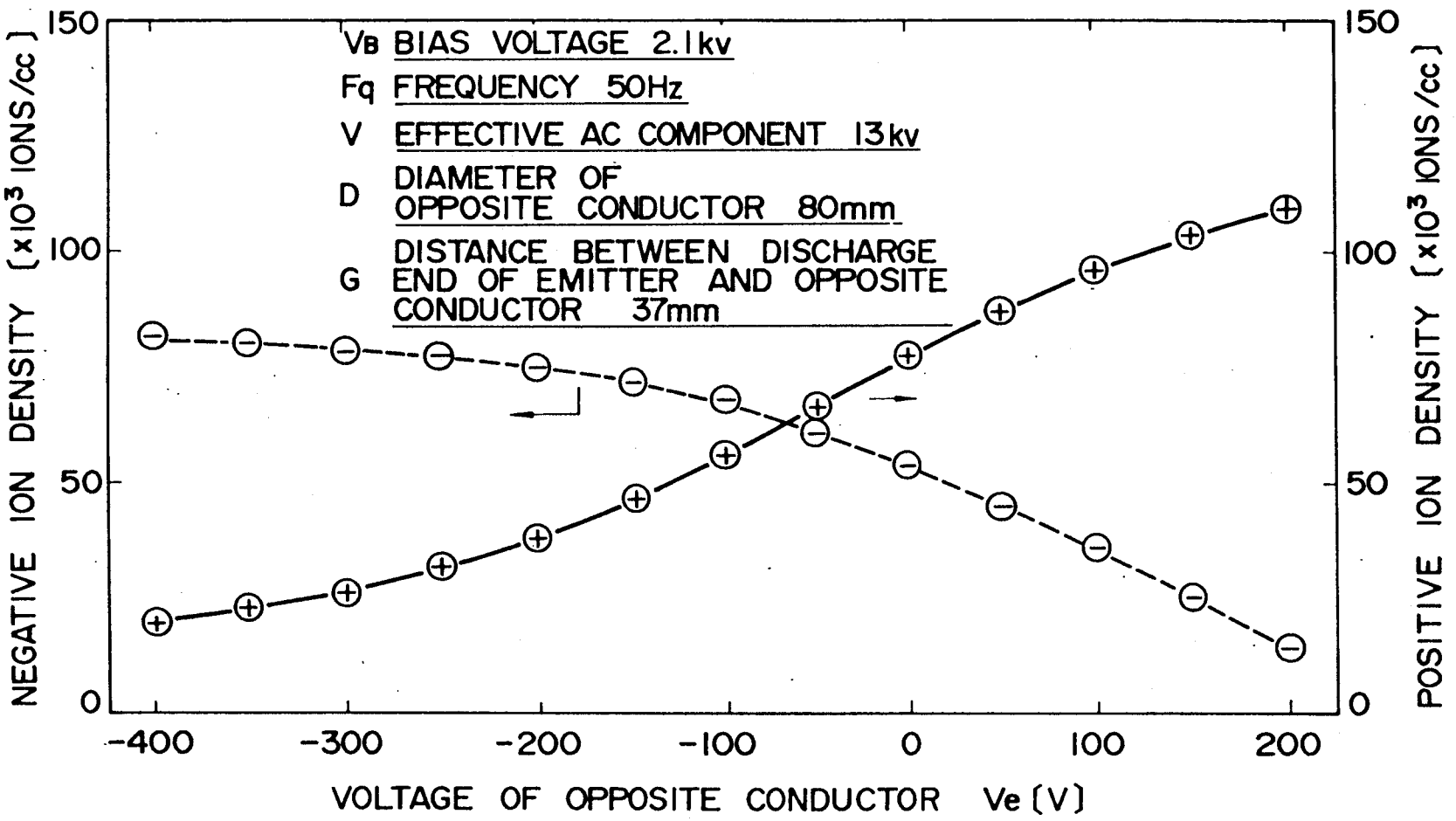
FIG. 12 is a graph showing measured positive and negative ion densities plotted against the DC voltage applied to the opposite conductor obtained in the test of FIG. 10 under the indicated conditions including the addition of a DC bias voltage to the AC voltage applied to the emitter.

FIG. 12 is a graph showing positive and negative ion densities measured by an ion density meter plotted against the DC voltage applied to the opposite conductor under the same test conditions as with respect to FIGS. 10 and 11 except that a positive DC bias voltage ($V_B$) is added to the AC voltage applied to the emitter. While the intensity and polarity of the DC bias voltage added to the AC may be varied, FIG. 12 shows data of an example wherein the added DC bias voltage is 2.1 kV. In the apparatus of FIG. 1, the addition of a bias voltage to the AC can be made by connecting a DC transformer 41 to the AC voltage controlling device 5. Advantageous results of the addition of a DC bias voltage are apparent from the results shown in FIG. 12. Namely, where a bias voltage of 2.1 kV is added as in FIG. 12, the overall negative ion density increases (when compared with the case where no bias voltage is added as in FIG. 11). For example, in the case of FIG. 12, even if $V_e$ is 0 V, the difference between the positive and negative ion densities is smaller, and by application of a $V_e$ of only −63 V to the opposite conductor, positive and negative ions concentrations are well balanced at a density of about $63 \times 10^3$ ions/cc, which is higher than the $48 \times 10^3$ ions/cc density in the case of FIG. 11. Accordingly, it is preferable to add a DC transformer 41 to the AC voltage controlling device 5 of the apparatus as shown in FIG. 1, thereby adding a positive or negative DC bias voltage to the AC applied to the emitters.

Figure 13:
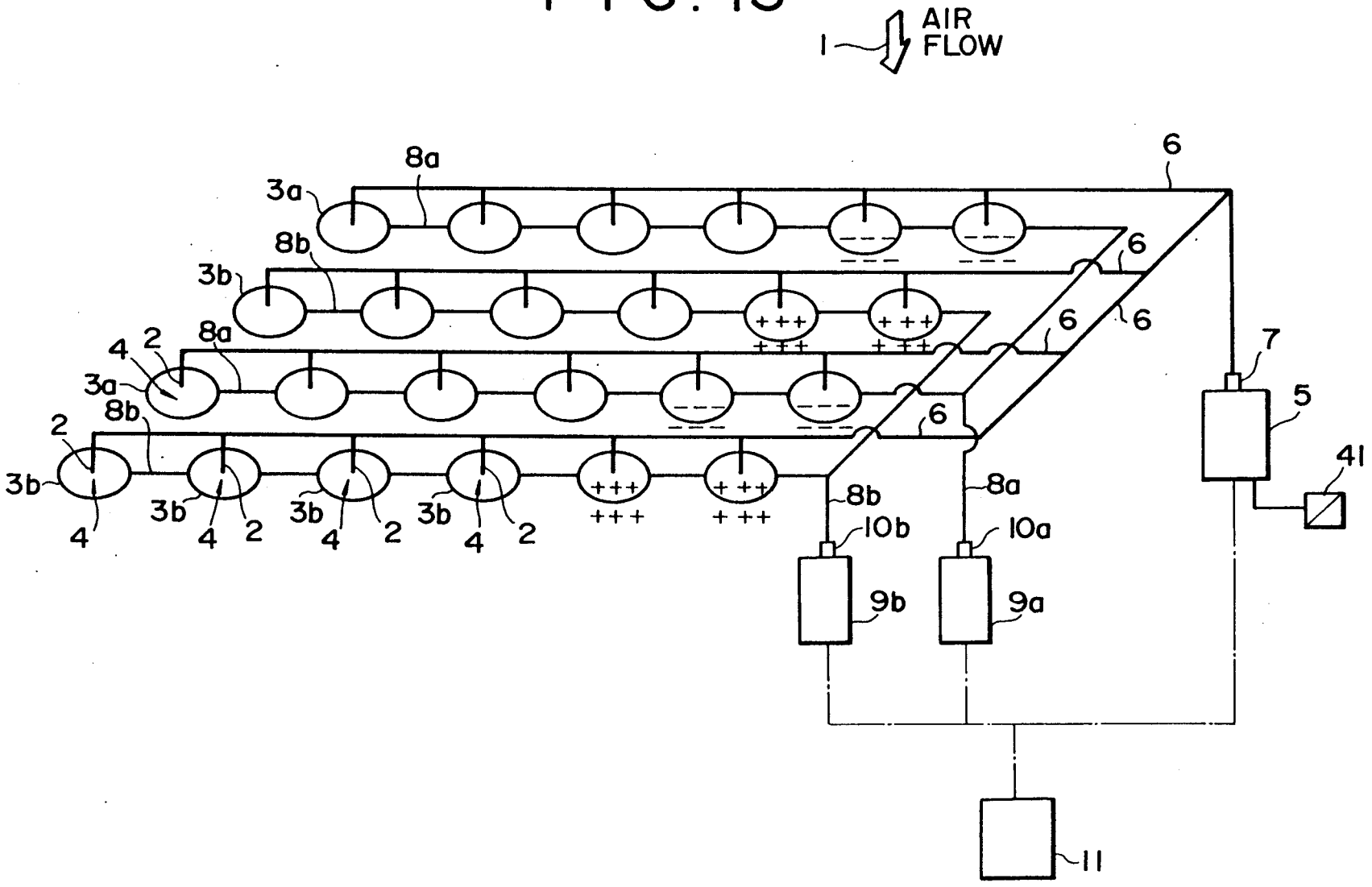
FIG. 13 is a schematic perspective view of another example of an air ionizer which may be used according to the apparatus of the present invention.

FIG. 13 is a schematic perspective view of another example of an air ionizer which may be used according to the present invention. In this case, a DC voltage of a certain intensity is applied to opposite conductors of some discharge pairs, while a DC voltage of a different intensity is applied to opposite conductors of the other discharge pairs, whereby some discharge pairs may continuously generate a high concentration of positive ions, while the other discharge pairs may continuously generate a high concentration of negative ions. In the illustrated example, DC voltage controlling devices 9*a* and 9*b* are capable of outputting DC of different voltages from their respective outputs 10*a* and 10*b*. Some opposite conductors 3*a* are connected to the output 10*a* via an insulated conductive line 8*a*, while the other opposite conductors 3*b* are connected to the output 10*b* via an insulated conductive line 8*b*. More specifically, six discharge pairs 4, each including the emitter 2 and the opposite conductor 3, are arranged in a line at substantially the same interval, and four such lines are arranged substantially in parallel with in substantially a same plane. Opposite conductors 3*a* in the first line and opposite conductors 3*a* in a third line are connected through a common insulated conductive line 8*a* to the output 10*a* of the DC voltage controlling device 9*a*, while the opposite conductor 3*b* in the second line and opposite conductors 3*b* in the fourth line are connected through a common insulated conductive line 8*b* to the output 10*b* of the DC voltage controlling device 9*b*. When a negative DC voltage is applied at output 10*a*, while a more positive DC voltage is applied at output 10*b*, negative ion rich air is continuously generated from each opposite conductor 3*a*, while positive ion rich air is continuously generated from each opposite conductor 3*b*.

For example, where each discharge pair has the same structure as that used in the test of FIG. 11, and an AC voltage having a frequency of 50 Hz and a voltage of 13 kV is applied to the emitters, each opposite conductor 3*a* will generate ionized air having a high negative ion density and a low positive ion density by outputting a DC voltage (e.g. more negative than −300 V) from the output 10*a*, and each opposite conductor 3*b* will generate ionized air having a high positive ion density and a substantially nil negative ion density by outputting a DC voltage (e.g. more positive than 0 V) from the output 10*b*. Likewise, if a bias DC voltage of 2.1 kV is added to the AC applied to emitters as in the test of FIG. 12, negative ion rich air and positive ion rich air will be continuously and stably generated from each opposite conductor 3*a* and 3*b*, respectively, by outputting a DC voltage (e.g. −400 V) from the output 10*a* and a DC voltage (e.g. +200 V) from the output 10*b*. Accordingly, by appropriately arranging a plurality of the opposite conductors 3*a* generating negative ion rich air and the opposite conductors 3*b* generating positive ion rich air in a two dimensional expanse transversing the air flow (for example, by alternately arranging a line of the opposite conductors 3*a* and a line of the opposite conductors 3*b* as shown in FIG. 1, or by arranging the individual opposite conductors 3*a* and 3*b* alternately or in a zigzag fashion, or by arranging a small group of the opposite conductors 3*a* and a small group of the opposite conductors 3*b* alternately), it is possible to supply ionized air having a balanced number of positive and negative ions to the charged articles located downstream from the ionizer.

Figure 14:
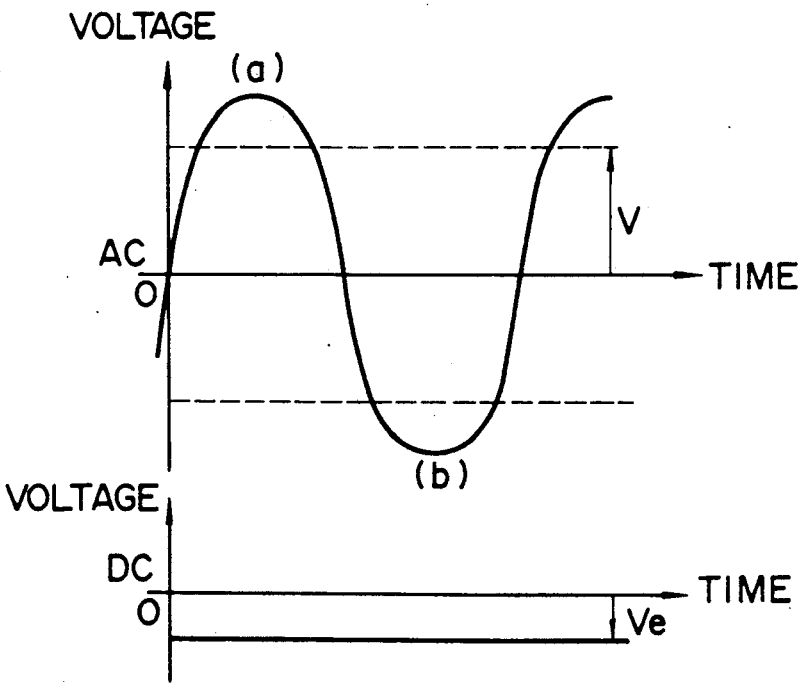
FIG. 14 depicts waveform diagrams of the AC and DC voltage applied to the apparatus according to the present invention.
Figure 15:
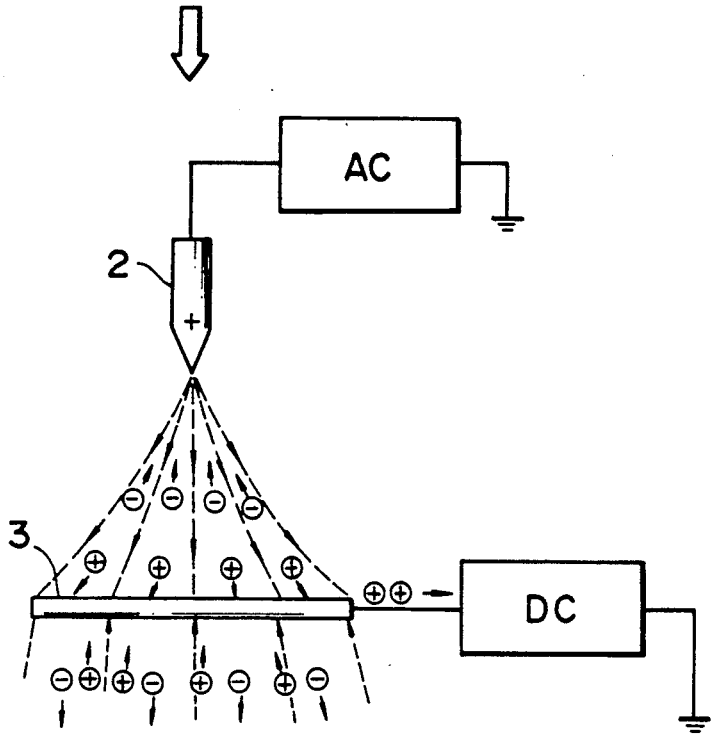
FIG. 15 is an explanatory diagram for showing the state of the electric field at the time an emitter is in a pulse phase in the case where a minus DC voltage is applied to the opposite conductor.
Figure 16:
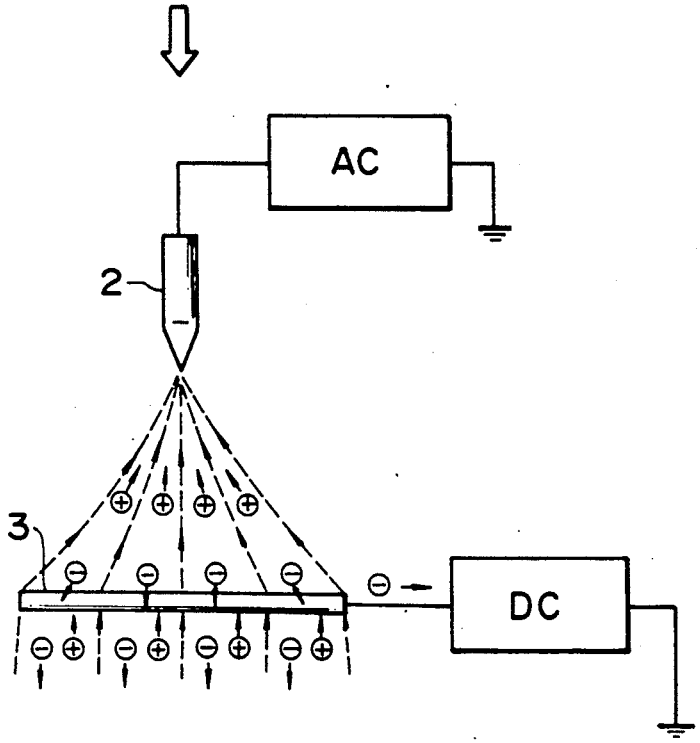
FIG. 16 is an explanatory diagram for showing the state of the electric field at the time an emitter is in a minus phase in the case wherein a minus DC voltage is applied to the opposite conductor.
Figure 17:
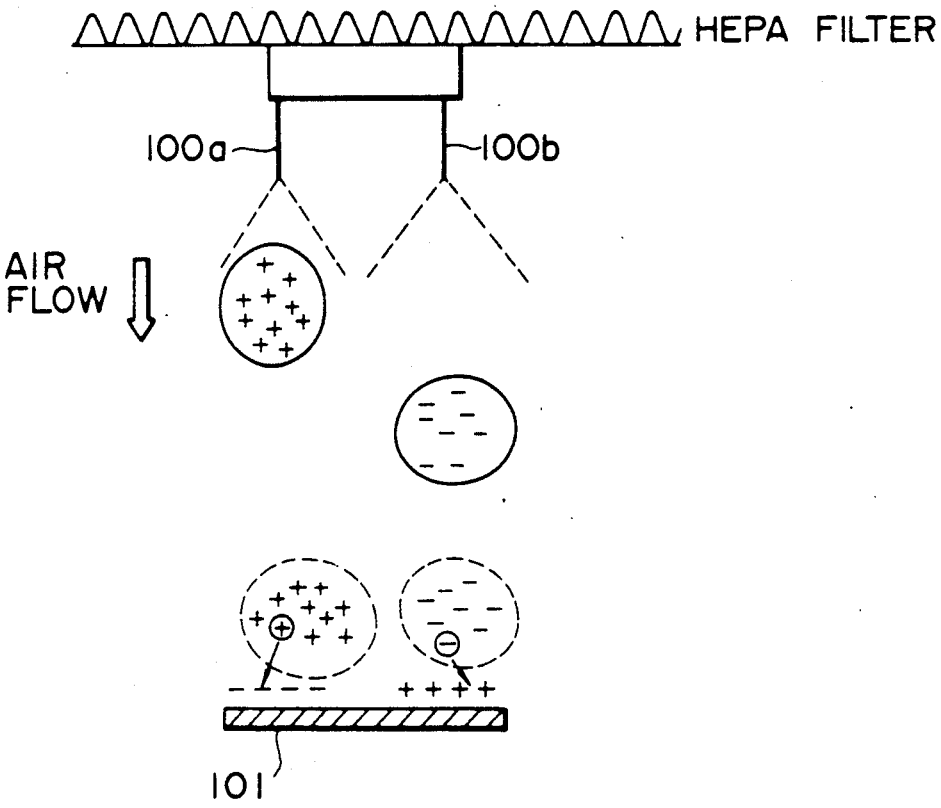
FIG. 17 is a schematic illustration of a conventional pulsed DC type ionizer.
Figure 18:
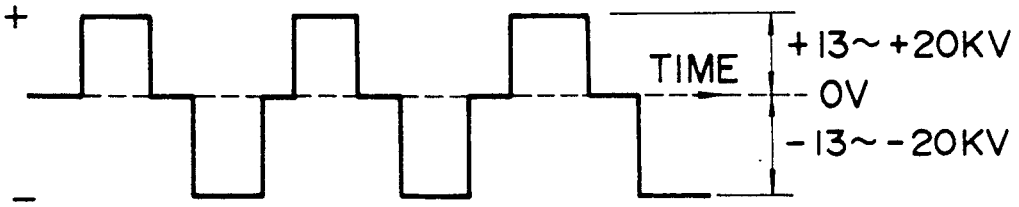
FIG. 18 is a waveform diagram of a voltage applied to the ionizer of FIG. 17.
Figure 19:
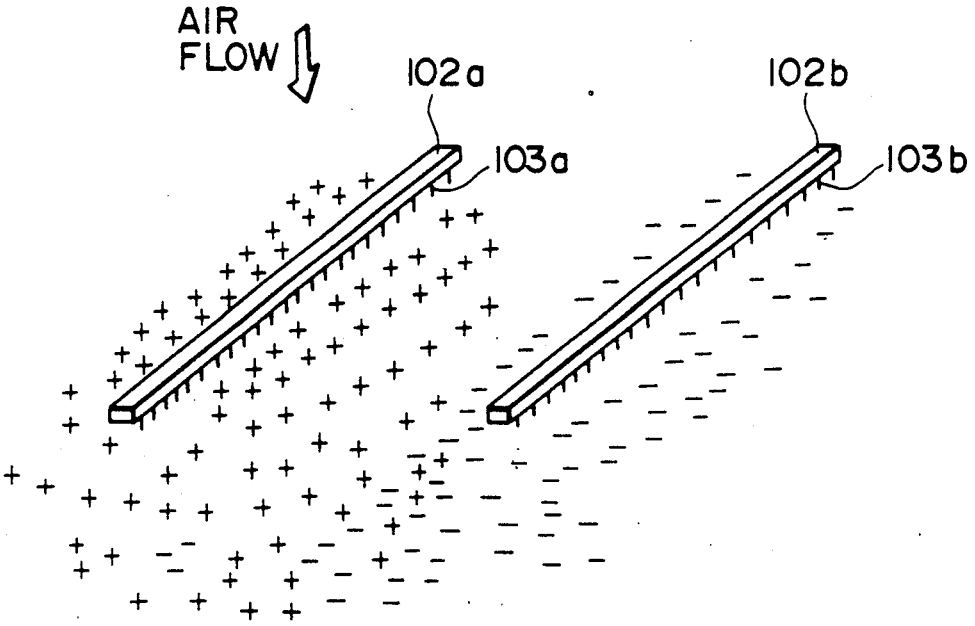
FIG. 19 is a schematic illustration of a conventional DC type ionizer.
Figure 20:
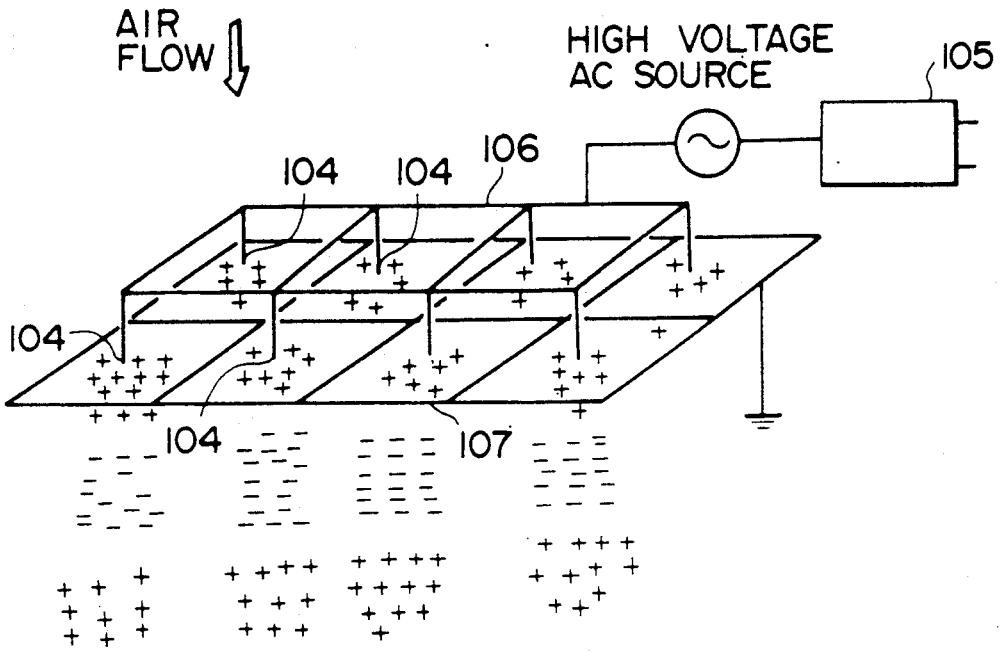
FIG. 20 is a schematic illustration of a conventional AC type ionizer.
Figure 21:
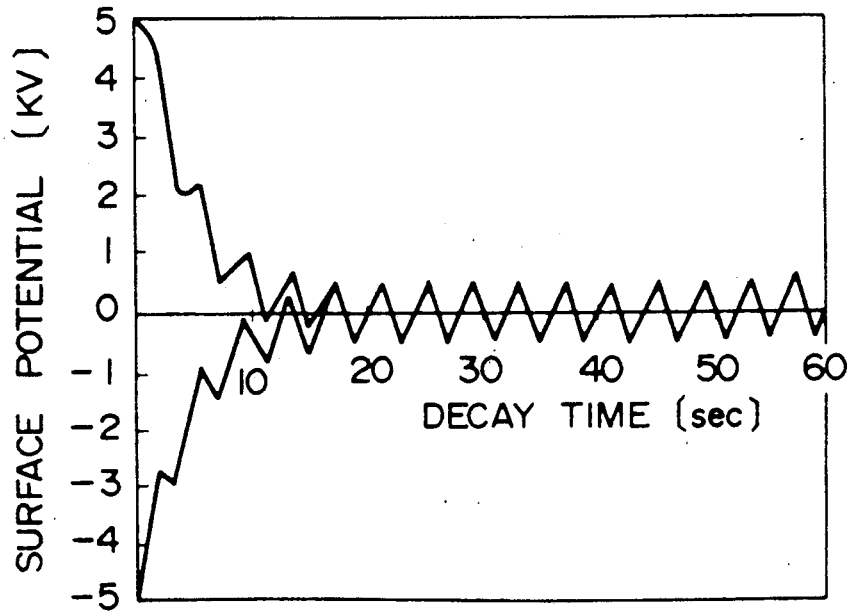
FIG. 21 shows an example of a change of a surface potential of a charged article with respect to time when a conventional pulsed DC type ionizer is used.
Figure 22:
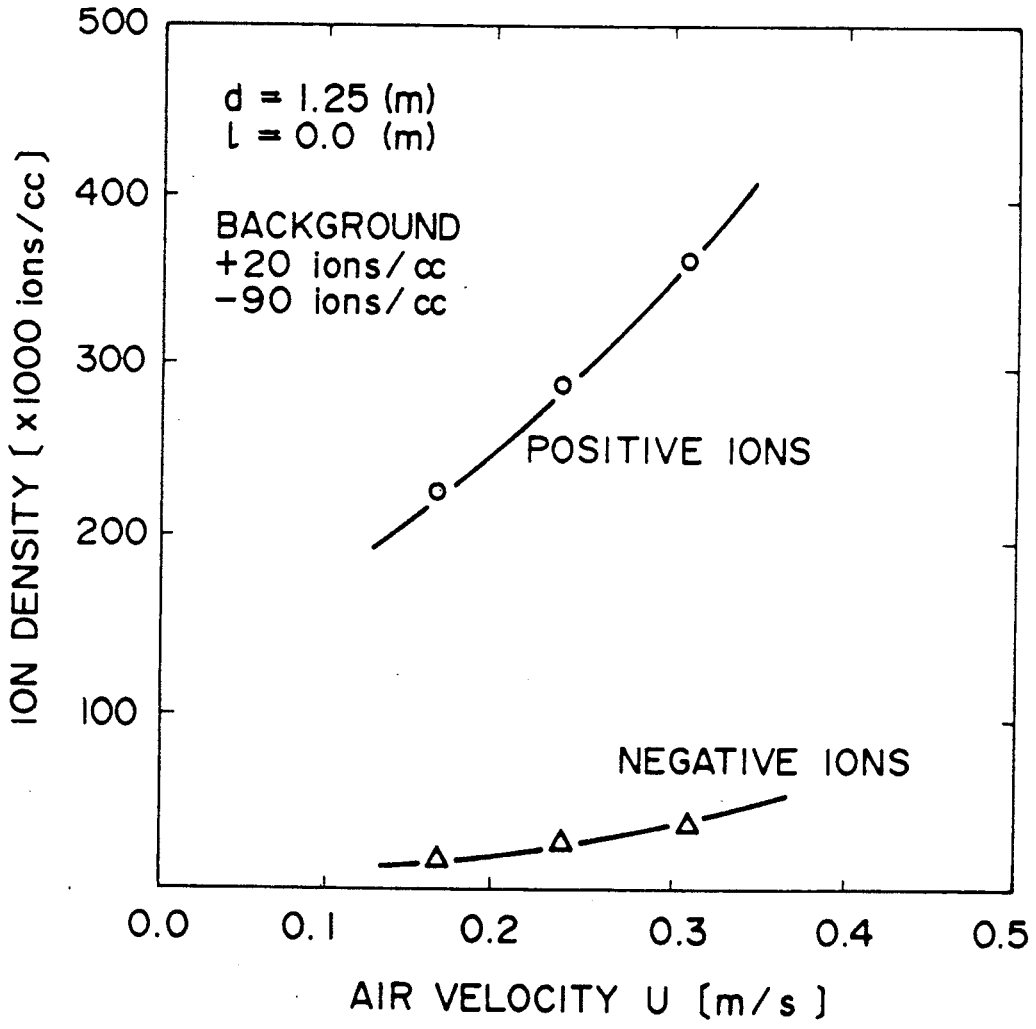
FIG. 22 shows an example of positive and negative ion densities generated by a conventional AC type ionizer.

FIGS. 14 to 16 are for illustrating effects of the DC voltage or voltages applied to the opposite conductors. AC type ionizers inevitably generate more positive ions than negative ions where $V_e$ is 0. However, where a sufficient effective AC component for corona discharge as shown in FIG. 14 is being applied to the emitter, if a negative $V_e$ is applied to the opposite conductor in accordance with the present invention, in either case wherein the emitter 2 is in a positive (FIG. 15) or negative (FIG. 16) phase, an electric field directed to the opposite conductor 3, as shown by broken arrows, is formed downstream of the opposite conductor 3 with respect to the air flow. Thus, by the electric field formed, a Coulomb force is always present from causing negative ions, which have gone through the opposite conductor 3, to move downwards, irrespective of the polarity of the emitter, thereby increasing a negative ion density arriving at the charged articles located downstream. If this reasoning is correct, the discharge end 21 of the emitter 2 should be preferably positioned upstream of the opposite conductor 3 with respect to the air flow, as shown in FIG. 7. If the discharge end 21 of the emitter 2 is positioned downstream of the opposite conductor 3 with respect to the air flow, as shown in FIG. 8, the intended effect of increasing the negative ion density will be reduced. We have experimentally found that although the a structure of the discharge pair, as shown in FIG. 8, may be preferred in some cases where a high AC voltage having added thereto a certain bias is applied to the emitter side, in general the discharge end 21 of the emitter 2 should preferably be positioned upstream from the opposite conductor 3 with respect to the air flow, as shown in FIG. 7.

We have repeated the tests while varying the parameter G shown in FIGS. 7 and 8, and the parameters D, V and $V_e$. It has been found that optimum operating conditions for the apparatus according to the present invention in a clean room, where the air flow rate is from 0.15 to 0.6 m/sec, include:

$$-80 \text{ mm} \leqq G \leqq 80 \text{ mm},$$
$$50 \text{ mm} \leqq D \leqq 150 \text{ mm},$$
$$8 \text{ kV} \leqq V, \text{ and}$$
$$-500\ V \leqq V_e \leqq 500 \text{ kV}.$$

In the test of FIG. 10, where a high AC voltage of 20 kV was applied to the emitter, no generation of dust from the discharge end 21 was detected. In contrast, in the same test where an emitter with the tungsten rod 12 exposed was used, with other conditions remaining the same, there was a significant generation of dust from the discharge end 21 when a high AC voltage in excess of 6 kV was applied to the emitter. The number of particles having a size of larger than 0.03 μm measured at a location 160 mm below the discharge end was $7.4\times10^2$ particles/ft$^3$ at 6 kV, $2.5\times10^4$ particles/ft$^3$ at 10 kV, and $2.9\times10^4$ particles/ft$^3$ at 20 kV. An emitter having a quartz tube 14 recommended herein was made to operate for a continued period of 1050 hours. At the end of the period, the discharge end of the emitter was examined by a microscope. It could not be distinguished from a new one, and no deposition of particulate dust and no damage were observed. Furthermore, an AC voltage of 11.5 kV was applied to an emitter recommended herein and an ozone concentration was examined at a location 12.5 cm below the discharge end of the emitter. Ozone in excess of 1 ppb was not detected.

By the apparatus according to the present invention almost all problems associated with the prior art can be solved and the difficulties caused by static electrification in the production of the semiconductor devices can be overcome.

What is claimed is:

1. An apparatus for removing static electricity from charged articles existing in a clean space comprising an AC ionizer having a plurality of needle-like emitters disposed in a flow of filtered clean air, wherein an AC high voltage is applied to said emitters to effect corona discharge for ionizing air, whereby a flow of thus ionized air is supplied onto said charged articles to neutralize static electricity thereon, said apparatus characterized in that:

a discharge end of each of said needle-like emitters is coated with a dielectric ceramic material;

each of said emitters is disposed with its discharge end spaced apart by a predetermined distance from a grid-like or loop-like opposite conductor, each emitter and associated opposite conductor forming a discharge pair;

a plurality of such discharge pairs are arranged in a two dimensional expanse in a direction transversing a flow direction of said flow filtered clean air;

each opposite conductor of said discharge pairs is connected to a DC voltage source; and there is provided a means for adjusting a DC voltage applied to each opposite conductor from said DC voltage source.

2. An apparatus for removing static electricity from charged articles existing in a clean space comprising an AC ionizer having a plurality of needle-like emitters disposed in a flow of filtered clean air, wherein an AC high voltage is applied to said emitters to effect corona discharge for ionizing air, whereby a flow of thus ionized air is supplied onto said charged articles to neutralize static electricity thereon, said apparatus characterized in that:

a discharge end of each of said needle-like emitters is coated with a dielectric ceramic material;

each of said emitters is disposed with its discharge end spaced apart by a predetermined distance from a grid-like or loop-like opposite conductor, each emitter and associated opposite conductor forming a discharge pair;

a plurality of such discharge pairs are arranged in a two dimensional expanse in a direction transversing a flow direction of said flow of filtered clean air;

opposite conductors of said discharge pairs are connected to a common DC voltage source; and there is provided a means for adjusting a DC voltage applied to said opposite conductors from said common DC voltage source, wherein each of said discharge pairs ionizes air to provide substantially balanced positive and negative ion densities.

3. An apparatus for removing static electricity from charged articles existing in a clean space comprising an AC ionizer having a plurality of needle-like emitters disposed in a flow of filtered clean air, wherein an AC high voltage is applied to said emitters to effect corona discharge for ionizing air, whereby a flow of thus ionized air is supplied onto said charged articles to neutralize static electricity thereon, said apparatus characterized in that:

a discharge end of each of said needle-like emitters is coated with a dielectric ceramic material;

each of said emitters is disposed with its discharge end spaced apart by a predetermined distance from a grid-like or loop-like opposite conductor, each emitter and associated opposite conductor forming a discharge pair;

a plurality of such discharge pairs are arranged in a two dimensional expanse in a direction transversing a flow direction of said flow of filtered clean air;

opposite conductors of some of said discharge pairs are connected to a first DC voltage source, and opposite conductors of the other of said discharge pairs are connected to a second DC voltage source; and there is provided a means for independently adjusting a DC voltage output of each of said first and second DC voltage sources, wherein the discharge pairs connected to said first DC voltage source generate ions inclined to one of a positive and negative polarity, and the discharge pairs connected to said second DC voltage source generate ions inclined to the other one of a positive and negative polarity.

4. An apparatus for removing static electricity from charged articles existing in a clean space comprising an AC ionizer having a plurality of needle-like emitters disposed in a flow of filtered clean air, wherein an AC high voltage is applied to said emitters to effect corona discharge for ionizing air, whereby a flow of thus ionized air is supplied onto said charged articles to neutralize static electricity thereon, said apparatus characterized in that:

a discharge end of each of said needle-like emitters is coated with a dielectric ceramic material;

each of said emitters is disposed with is discharge end spaced apart by a predetermined distance from a grid-like or loop-like opposite conductor, each emitter and associated opposite conductor forming a discharge pair;

a plurality of such discharge pairs are arranged in a two dimensional expanse in a direction transversing a flow direction of said flow of filtered clean air;

each opposite conductor of said discharge pairs is connected to a DC voltage source;

there is provided means for adjusting a DC voltage applied to each opposite conductor from said DC voltage source;

each emitter of said discharged pairs is connected to a high voltage AC source having added thereto one of a positive and negative bias voltage; and there is provided a means for adjusting an intensity of a voltage output from said AC source and for adjusting an intensity and polarity of said bias voltage.

5. The apparatus for removing static electricity from charged articles according to claim 1, 2, 3 or 4 wherein said clean space is for the production of semiconductor devices.

6. The apparatus for removing static electricity from charged articles according to claim 1, 2, 3, or 4 wherein said dielectric ceramic material is quartz.

7. The apparatus for removing static electricity from charged articles according to claim 1, 2, 3 or 4 wherein the discharge end of each emitted is positioned upstream of the associated 8. The apparatus for removing static electricity from charged articles according to claim 5 wherein said dielectric ceramic material is quartz.

9. The apparatus for removing static electricity from charged articles according to claim 5 wherein the discharge end of each emitter is positioned upstream of the associated opposite conductor with respect to the flow direction.

10. The apparatus for removing static electricity from charged articles according to claim 5 wherein the discharge pairs are arranged in a two dimensional expanse in a direction perpendicular to said flow direction.

11. The apparatus for removing static electricity from charged articles according to claim 6 wherein the discharge end of each emitter is positioned upstream of the associated opposite conductor with respect to the flow direction.

12. The apparatus for removing static electricity from charged articles according to claim 6 wherein the discharge pairs are arranged in a two dimensional expanse in a direction perpendicular to said flow direction.

13. The apparatus for removing static electricity from charged articles according to claim 7 wherein the discharge pairs are arranged in a two dimensional expanse in a direction perpendicular to said flow direction.

14. The apparatus for removing static electricity from charged articles according to claim 4 wherein the discharge pairs having the opposite conductors connected to the first DC voltage source and the discharge pairs having the opposite conductors connected to the second DC voltage source are discretely arranged alternately in at least one direction within said two dimensional expanse.

15. The apparatus for removing static electricity from charged articles according to claim 1, 2, 3, 4 or 14 wherein the discharge pairs are arranged in a two dimensional expanse in a direction perpendicular to said flow.

* * * * *